United States Patent [19]

Osaki

[11] 4,434,538

[45] Mar. 6, 1984

[54] BOTTOM STOP APPLYING AND GAPPING APPARATUS FOR A SLIDE FASTENER CHAIN

[75] Inventor: Tatsuo Osaki, Uozu, Japan

[73] Assignee: Yoshida Kogyo K.K., Tokyo, Japan

[21] Appl. No.: 264,809

[22] Filed: May 18, 1981

[30] Foreign Application Priority Data

May 28, 1980 [JP] Japan ..... 55-73689[U]

[51] Int. Cl.[3] ..... B21D 53/56

[52] U.S. Cl. ..... 29/33.2; 29/408; 29/767

[58] Field of Search ..... 29/33.2, 408, 767, 33 R, 29/56.5, 417, 566.1, 564.6; 264/342 R

[56] References Cited

U.S. PATENT DOCUMENTS

| | | | |
|---|---|---|---|
| 2,096,685 | 10/1937 | Osgood | 29/767 |
| 4,137,621 | 2/1979 | Scagnelli | 29/408 |
| 4,236,292 | 12/1980 | Orr et al. | 29/408 |

*Primary Examiner*—Z. R. Bilinsky

*Attorney, Agent, or Firm*—Robert E. Burns; Emmanuel J. Lobato; Bruce L. Adams

[57] ABSTRACT

An apparatus is disclosed for applying bottom end stops to a slide fastener chain and simultaneously gapping the chain at predetermined intervals. The apparatus includes a means for positioning and holding a group of fastener elements on the chain, said means being pivotally movable in contact with the applied bottom stop in a plane either perpendicular to or parallel with the plane of the chain.

7 Claims, 12 Drawing Figures

BOTTOM STOP APPLYING AND GAPPING APPARATUS FOR A SLIDE FASTENER CHAIN

BACKGROUND OF THE INVENTION

1. Field of the Invention

This invention relates to an apparatus for gapping a slide fastener chain at predetermined intervals along its length substantially simultaneously as applying a bottom end stop to the chain adjacent to the gapped section thereof.

2. Prior Art

Gapping apparatus known in the art comprise a cutting punch and a die cooperating in removing a group of fastener coupling elements from selected portions of a continuous slide fastener chain. The apparatus further comprise means for positioning and holding the coupling elements from opposite sides thereof during the gapping operation to prevent twisting or misalignment of the element which would otherwise occur under the influence of pressure applied by the punch. However, in the case where applying of bottom end stops simultaneously with gapping is desired as often done in the conventional practice, it was further necessary to provide means for retracting or otherwise moving the holding means out of the path of the bottom stop when advancing the fastener chain, because the bottom stop to be attached to the stringer tapes astride coupled pairs of fastener elements is sized larger than the coupled pair of fastener elements and would therefore impinge upon the holding means, blocking the feeding of the fastener chain.

There is disclosed in U. K. Patent Application No. GB 2021681.A a bottom stop applying and gapping mechanism which comprises a pair of slidable plates for positioning and holding the fastener elements, the plates being movable toward and away from each other and connected to a camming rod which operates in response to the lowering and raising of the punch to move the plates in the transverse direction of a slide fastener chain. This mechanism is not only complicated but also requires the plates to be retracted away from the element once a cycle of gapping operation is completed so as to permit advancing of the fastener chain.

Retraction of the plates creates a time lag between completion and initiation of a gapping and bottom stop applying operation. This time lag may be only appreciable when measured per cycle of operation but would aggregate considerably when measured over so many cycles required to finish the whole continuous length of a slide fastener chain.

SUMMARY OF THE INVENTION

With the foregoing drawbacks of the prior art in view, the present invention is aimed at the provision of a combination bottom stop applying and gapping apparatus which is relatively simple in construction and highly efficient in performance.

A more specific object of the invention is to provide a combination bottom stop applying and gapping apparatus incorporating an improved element holding means, which apparatus is capable of gapping a slide fastener chain simultaneously with applying of a bottom end stop without having to retract or otherwise move the holding means out of the path of feeding of the fastener chain.

The apparatus of the invention includes a first punch and die unit for applying bottom end stop each at a time to a slide fastener chain, a second punch and die unit for removing a group of fastener elements from selected sections of the chain, and a means positioning and holding the fastener elements during the gapping operation, said means being engageable with the applied bottom stop and thereby pivotally movable in a plane either perpendicular to or parallel with the plane of the fastener chain.

The above and other objects, advantages and features of the invention will become apparent from the detailed description taken with reference to the accompanying drawings illustrating by way of example a preferred embodiment which the invention may assume in practice.

BRIEF DESCRIPTION OF THE DRAWINGS

In the drawings wherein like reference numerals refer to like or corresponding parts throughout the several view.

DETAILED DESCRIPTION OF THE PREFERRED EMBODIMENTS

Figure 1:
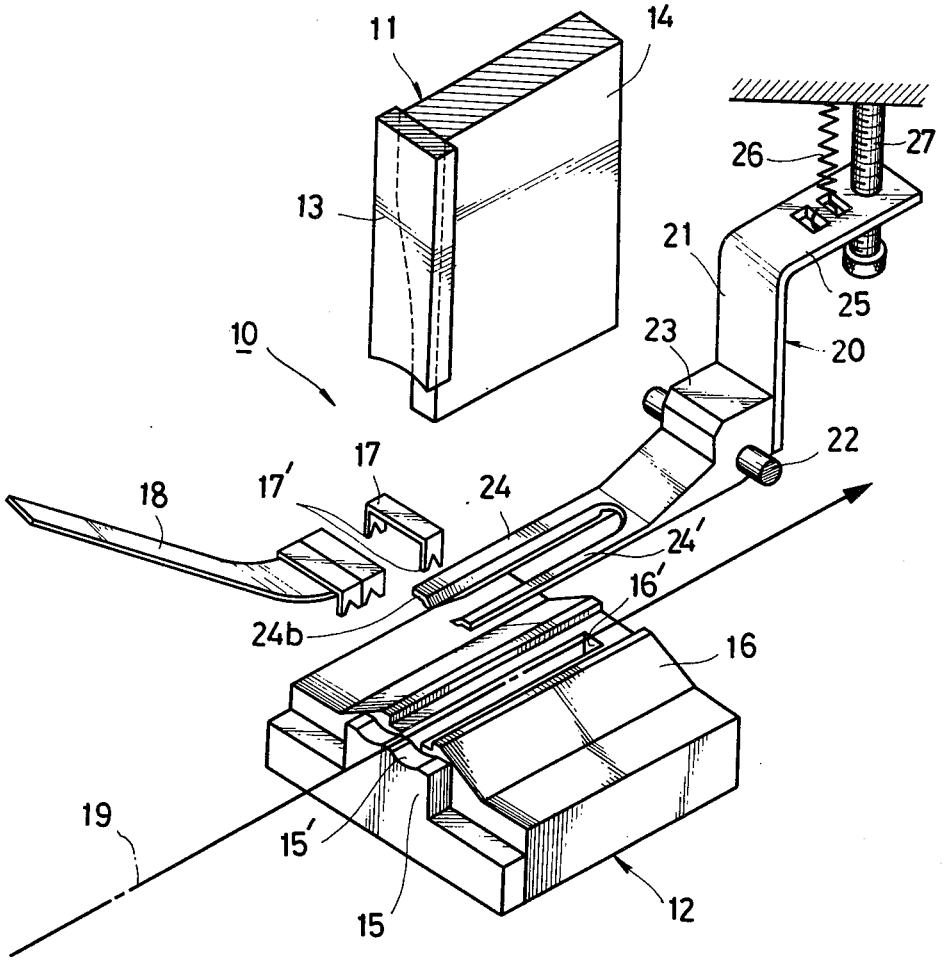
FIG. 1 is an exploded perspective view of an apparatus according to the invention.
Figure 2:
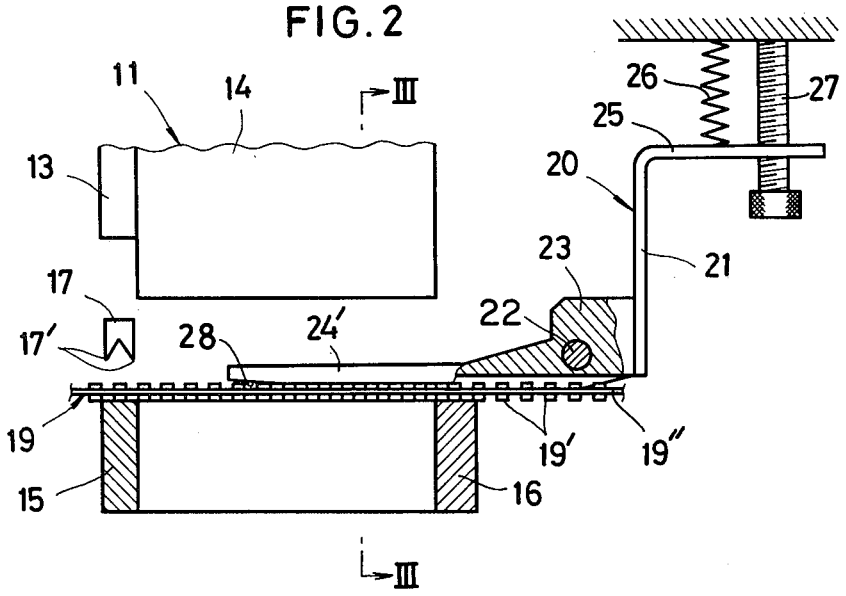
FIG. 2 is a side elevational, partly sectional, view of the apparatus of FIG. 1.
Figure 3:
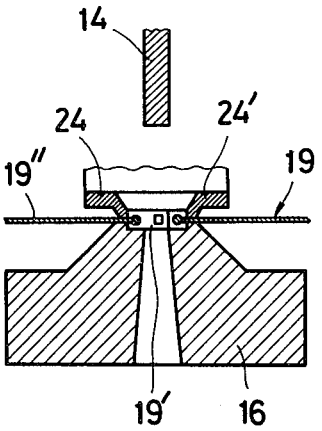
FIG. 3 is a cross-sectional view taken on the line III—III of FIG. 2.

Referring now to the drawings and FIGS. 1 and 2 in particular, there is shown a combination bottom stop applying and gapping apparatus generally designated 10 which essentially comprises a punch assembly 11 mounted on a machine frame not shown for vertical movement along a path registering with a die assembly 12 mounted stationarily on a machine base not shown. The punch assembly 11 comprises a clamping punch 13 and a cutting punch 14 both being of an integral formation. The die assembly 12 comprises a clamping die 15 and a cutting die 16 both also being of an integral formation.

Staple-like bottom end stops 17 are supplied from a chute 18 of any conventional form and each held in a nest or pocket not shown at a position registering with the path of movement of the clamping punch 13 as shown in FIG. 1. A dowaward stroke of the punch assembly 11 urges bottom stops 17 one at a time against a slide fastener chain 19 (hereafter referred to simply as a chain) schematically shown in FIG. 2 and clamps the same thereon in the well known manner, for which purpose the die 15 is arcuately recessed as at 15' for facilitating curling of the bottom stop 17 along its ends 17'. During the same downward stroke of the punch assembly 11, gapping of the chain 19 takes place substantially simultaneously as the bottom stop 17 is applied, for which purpose the cutting punch 14 extends slightly beyond the clamping surface of the companion punch 13 so as to ensure removal of a selected group of coupling elements 19' from the chain 19 by the time the bottom stop 17 has been clamped in place. To permit the cutting punch 14 to thrust through the chain 19, the coacting die 16 has an opening 16' complementary in shape and size with the operating edge of the die 14.

Since any of the foregoing structural members are well known for their construction and function, no further detailed discussion thereon will therefore be required.

Now, according to the invention, there is provided a means 20 for positioning and holding the chain 19, or particularly fasteners elements 19' over a selected length thereof, during the bottom stop applying and gapping operation. To eliminate the drawbacks of the prior art or to achieve the objects of the invention as noted above, the element positioning and holding means 20 incorporates structural features such that the means 20 per se need not be retracted or moved away from the path of movement of the chain 19 upon application of the bottom stop 17.

Figure 4:
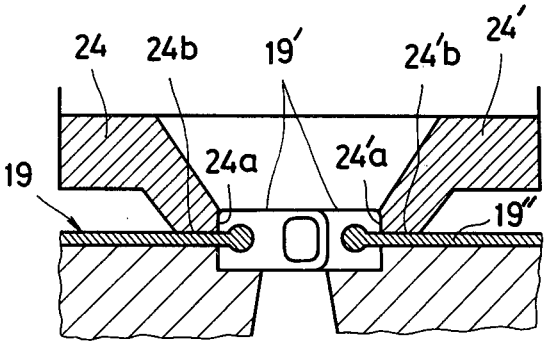
FIG. 4 is an enlarged view of a portion of FIG. 3.

The element positioning and holding means 20 according to a preferred embodiment of the invention comprises a crank arm 21 mounted on a pin 22 rotatably supported by the machine base and extending transversely through a shank portion 23 thereof. The crank arm 21 has one of its ends bifurcated substantially in the form of a fork having two parallel fingers or prongs 24, 24'. The prongs 24, 24' have tapered confronting inner edges **24*a*, 24'*a* which are spaced by a distance corresponding to the transverse width of a coupled set of fastener elements 19' of a given size, and also have flat bottoms 24*b*, 24'*b* disposed for abutting engagement with fastener tapes 19'' adjacent to the coupling elements 19', as better shown in FIG. 4**.

Figure 5:
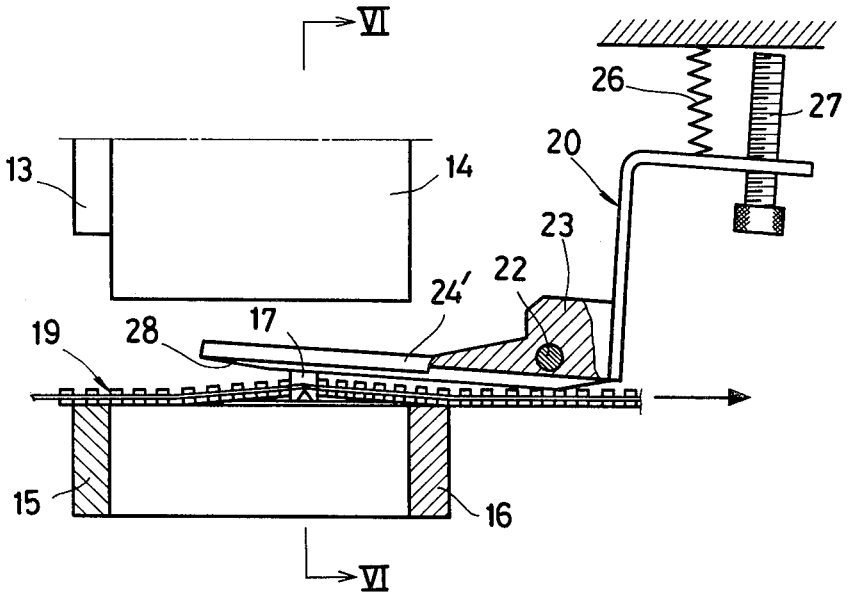
FIG. 5 is a view similar to FIG. 2 but showing a slide fastener chain in advancing movement after it has been attached with a bottom stop.
Figure 6:
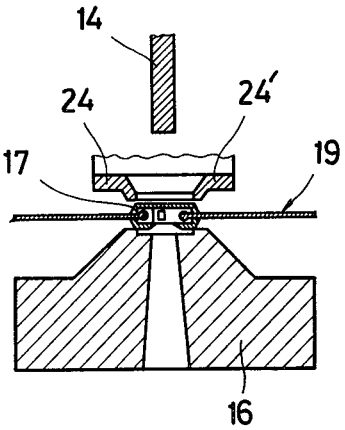
FIG. 6 is a cross-sectional view taken on the line VI—VI of FIG. 5.
Figure 7:
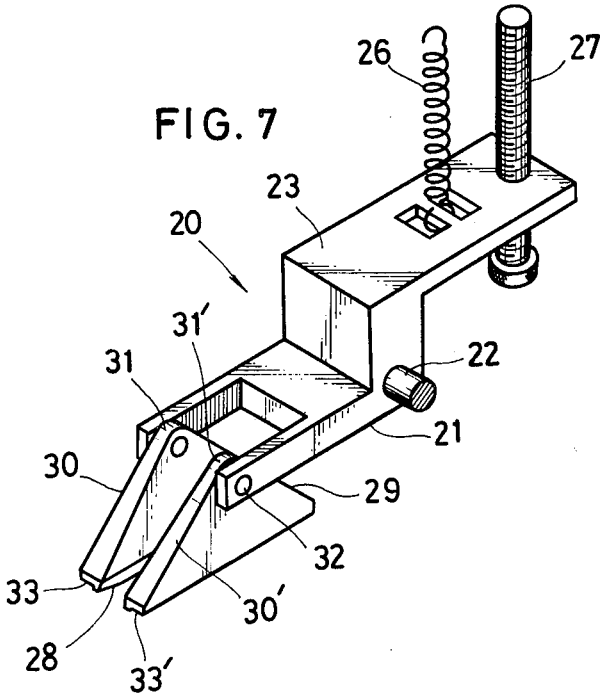
FIG. 7 is a perspective view of a modified form of element holding means.
Figure 8:
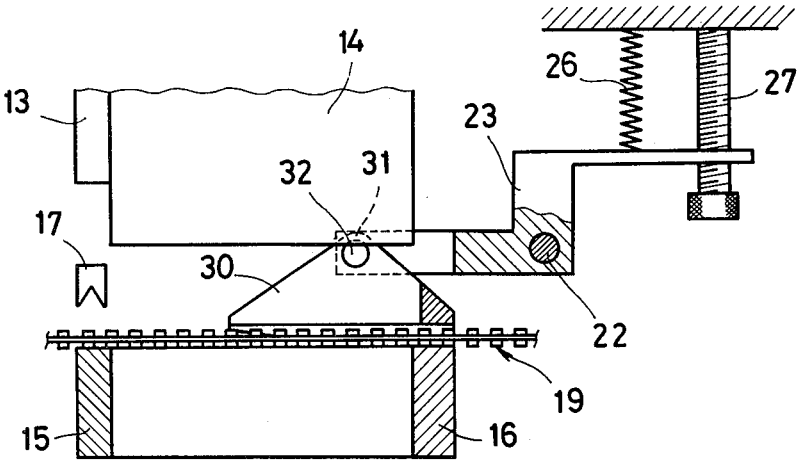
FIG. 8 is a side elevational, partly sectional view of the apparatus having mounted thereon the modified means of FIG. 7.

The crank arm 21 has at its other end a horizontally extending link 25 connected by an extension spring 26 to the machine frame, the extension spring 26 normally biasing the crank arm 21 toward the die assembly 12. Designated at 27 is an adjusting bolt threadedly engaged with the link 25 and having one of its ends normally rested against the machine frame. Although this adjusting bolt 27 is not absolutely necessary, it is preferred for the purpose of limiting the lowermost position of the crank arm 21 with respect to the die assembly 12 so as to prevent the prongs 24, 24' from extending excessive pressure to the fastener tapes 19''. The prongs 24, 24' have their respective lower surface portions tapered or sloped upwardly toward their respective free ends as at 28 shown in FIG. 2 to provide a clearance for the bottom stop 17 to enter therethrough unobstructedly under the prongs 24, 24' and subsequently move between the prongs 24, 24' and the die assembly 12 as the chain 19 is advanced in the direction of the arrow (FIG. 1) upon completion of a cycle of bottom stop applying and gapping operation. With further advancement of the chain 19, the applied bottom stop 17 urges the crank arm 21 to move apart from the die assembly 12 against the bias of the spring 26, as shown in FIG. 5 and continues to travel resiliently underneath the prongs 24, 24' until it clears the die assembly 12.

FIG. 7–10, inclusive, show a modification of the element positioning and holding means 20 according to the invention which is substantially similar in construction to that which is shown in and has been described with reference to FIGS. 1–6, inclusive, the only exception being noted in the portion 29 of the crank arm 21 which corresponds to the prongs 24, 24' of the first embodiment. The portion 29 comprises a pair of parallel triangular plates 30, 30' which are pivotally mounted at their respective apices 31, 31' on a pin 32 and which have their respective bases 33, 33' spaced apart to hold therebetween the rows of elements 19' from opposite sides thereof. The bases 33, 34' have their respective lower surface portions 28 tapered or sloped upward toward their respective free ends, similar to the prongs 24, 24' of the first embodiment.

Figure 9:
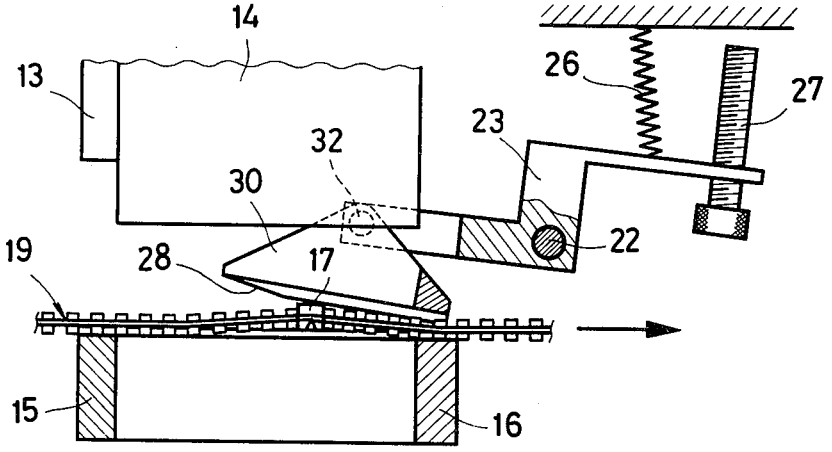
FIG. 9 is a view similar to FIG. 8 but showing the fastener chain in advancing movement with the attached bottom stop half-way in under the modified holding means.
Figure 10:
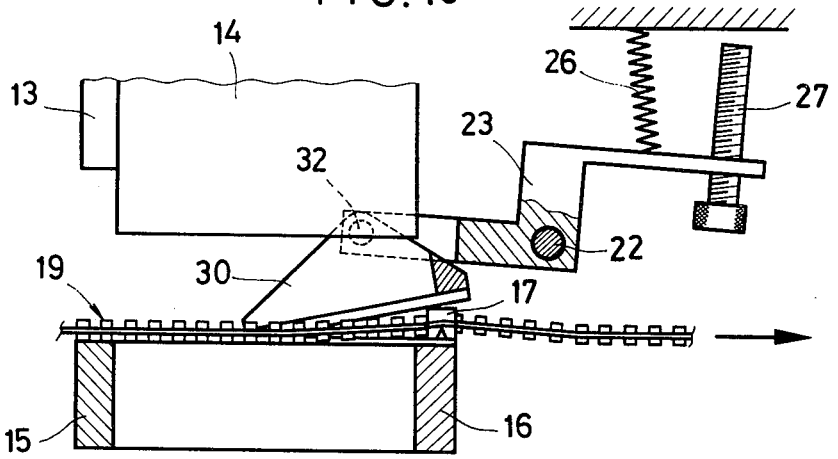
FIG. 10 is a view similar to FIG. 8 or FIG. 9 but showing the attached bottom stop half-way out under the modified holding means.

As the chain 19 advances in the direction of the arrow (FIGS. 9 and 10), the bottom stop 17 applied thereto enters in between the die assembly 12 and the plates 30, 30', urging the latter to pivot about the pin 32 and the pin 22 in a plane perpendicular to the plane of the chain 19 initially clockwise until the bottom stop 17 registers in position with the pivotal axis of the plates 30, 30' as shown in FIG. 9. As the bottom stop 17 moves past the pivotal axis of the plates 30, 30', then the latter is inverted in their pivoting direction; i.e. couterclockwise in the manner illustrated in FIG. 10. Upon departure of the bottom stop 17 from the die assembly 12, the plates 30, 30 return to their normal position (FIG. 8) under the influence of the biasing force of the spring 26. Thus, in this embodiment, the rows of fastener elements 19' are continuously guided by portions or whole of the bases 33, 33' of the plates 30, 30'.

Figure 11:
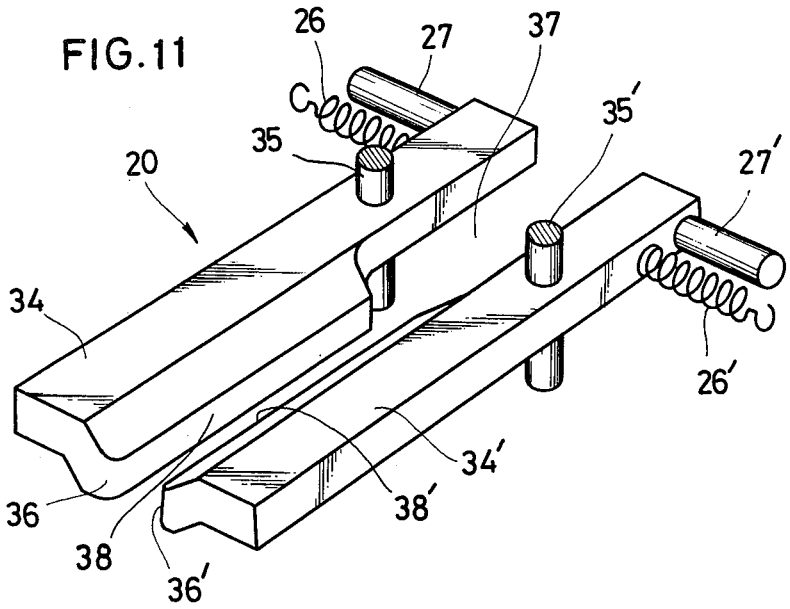
FIG. 11 is a perspective view of another modification of the element holding means according to the invention.

There is shown in FIG. 11 another modification of the element positioning and holding means 20 according to the invention. This modification comprises a pair of fingers in the form of elongated plate members 34, 34' which are spaced apart along their respective inner longitudinal edges 38, 38' for holding the fastener elements 19' therebetween. The plate members 34, 34' are pivotally mounted on their respective support pins 35, 35'. The plate members 34, 34' have their respective front ends rounded off as at 36, 36' to facilitate the entry therebetween of the bottom stop 17 attached to the chain 19. The bottom stop 17 on advancement urges the confronting plate members 34, 34' to move pivotally apart in a plane parallel with the plane of the chain 19 against the bias of the springs 26, 26'. The plate members 34, 34' are returned to normal position by the action of the springs 26, 26' when the bottom stop 17 has advanced into a bay 37 defined by the plate members 34, 34' adjacent to the support pins 35, 35'.

Figure 12:
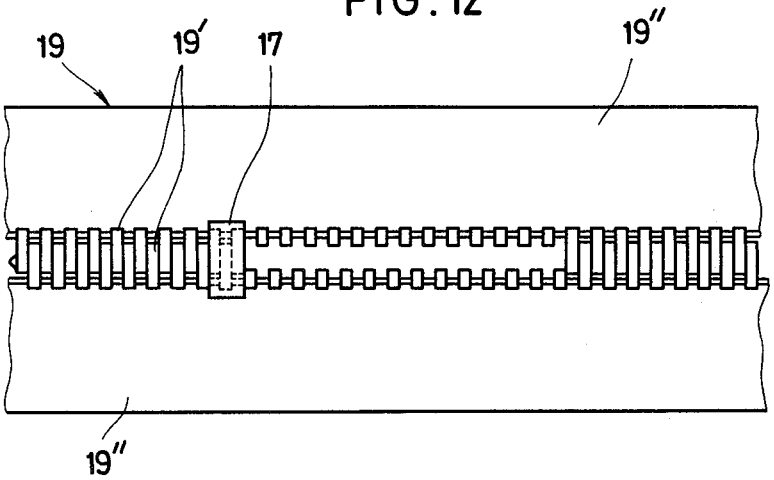
FIG. 12 is a plan view of a portion of slide fastener chain which has been applied with a bottom stop and has been simultaneously gapped.

For purposes of illustration, FIG. 12 is provided to depict the slide fastener chain 19 which has been gapped and applied with the bottom stop 17.

Although various minor modifications may be suggested by those versed in the art, it should be understood that I wish to embody within the scope of the patent warranted hereon, all such embodiments as reasonably and properly come within the scope of my contribution to the art.

Pins 27 and 27' engage the machine frame to limit movement of the plate members 34, 34' by the springs 26, 26'.

What is claimed is:

1. A bottom stop applying and gapping apparatus for a slide fastener chain having a pair of support tapes each carrying on and along its one longitudinal edge a row of fastener coupling elements, which apparatus comprises a punch assembly including a clamping punch and a cutting punch integral therewith, a die assembly including a clamping die and a cutting die integral therewith, said punch assembly and said die assembly cooperating in applying a bottom stop to the fastener chain and simultaneously gapping the chain at predetermined intervals, and a means for positioning and holding a group of fastener coupling elements on the chain, said means comprising a crank arm resiliently supported on a machine frame and having two parallel prongs spaced by a distance corresponding to the transverse width of a coupled set of fastener elements and have respective flat bottoms engageable with the support tapes, said crank arm having at one of its ends a link, a spring member connecting said link to the machine frame and normally biasing said crank arm toward said die assembly.

2. The apparatus of claim 1 including a means for adjusting the position of said crank arm with respect to said die assembly.

3. The apparatus of claim 1 wherein said prongs each have a tapered lower surface permitting the entry of the bottom stop under said prongs.

4. The apparatus of claim 1 wherein said positioning and holding mean includes a pair of spaced triangular plates pivotally movable about their respective apices in a plane perpendicular to the plane of the chain in contact with the bottom stop applied on the chain.

5. A bottom stop applying and gapping apparatus for a slide fastener chain having a pair of support tapes each carrying on and along its one longitudinal edge a row of fastener coupling elements, which apparatus comprises a punch assembly including a clamping punch and a cutting punch integral therewith, a die assembly including a clamping die and a cutting die integral therewith, said punch assembly and said die assembly cooperating in applying a bottom stop to the fastener chain and simultaneously gapping the chain at predetermined intervals, and a means for positioning and holding a group of fastener coupling elements on the chain, said means comprising two parallel fingers spaced apart by a distance corresponding to the transverse width of a coupled set of fastener elements and having flat bottoms engageable with the support tapes and inner edges engageable with said fastener elements, means pivotally supporting said fingers for movement away from said fastener elements to permit passage of said bottom stops, and spring means normally biasing said fingers toward said fastener elements.

6. The apparatus according to claim 5, wherein said fingers are pivotally movable in a plane parallel with the plane of the chain in contact with the bottom stop applied on the chain.

7. The apparatus according to claim 5, wherein means is provided for limiting movement of said fingers toward said fastener elments.

* * * * *